US011739499B2

(12) United States Patent
Kuehn et al.

(10) Patent No.: US 11,739,499 B2
(45) Date of Patent: Aug. 29, 2023

(54) DIFFERENT BOUNDARIES FOR IMPLEMENT FUNCTIONS WITH VIRTUAL FENCE TO AVOID TIRE OR STRUCTURAL DAMAGE

(71) Applicant: Caterpillar Inc., Peoria, IL (US)

(72) Inventors: Jeffrey L. Kuehn, Germantown Hills, IL (US); Vincent D. Jones, Chillicothe, IL (US); Michael C. Gentle, Maroa, IL (US); Michael S. Hill, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 313 days.

(21) Appl. No.: 17/079,017

(22) Filed: Oct. 23, 2020

(65) Prior Publication Data

US 2022/0127821 A1 Apr. 28, 2022

(51) Int. Cl.

| | |
|---|---|
| ***E02F 9/20*** | (2006.01) |
| ***E02F 9/26*** | (2006.01) |
| *E02F 3/84* | (2006.01) |

(52) U.S. Cl.

CPC ..... *E02F 9/2033* (2013.01); *E02F 9/265* (2013.01); *E02F 3/844* (2013.01)

(58) Field of Classification Search

CPC ..... E02F 9/2033; E02F 9/265; E02F 3/844; E02F 3/7636; E02F 3/845; E02F 9/0841

See application file for complete search history.

(56) References Cited

U.S. PATENT DOCUMENTS

| | | | | |
|---|---|---|---|---|
| 6,032,093 | A * | 2/2000 | Denbraber | E02F 3/308 700/304 |
| 7,676,967 | B2 | 3/2010 | Gharsalli et al. | |
| 2015/0259880 | A1* | 9/2015 | Sharma | E02F 9/2025 701/43 |
| 2016/0138249 | A1 | 5/2016 | Conway et al. | |
| 2018/0015927 | A1* | 1/2018 | Mitchell | B60W 10/18 |
| 2018/0347147 | A1* | 12/2018 | Doi | E02F 9/2033 |
| 2021/0340725 | A1* | 11/2021 | Velde | F16F 9/535 |

FOREIGN PATENT DOCUMENTS

| | | |
|---|---|---|
| JP | H11181821 | 7/1999 |
| JP | H11280106 | 10/1999 |

* cited by examiner

*Primary Examiner* — Tyler J Lee
*Assistant Examiner* — Yufeng Zhang
(74) *Attorney, Agent, or Firm* — Schwegman Lundberg & Woessner, P.A.

(57) ABSTRACT

An automated system for a machine can include a controller and a plurality of position sensors to deliver information regarding a position of a work tool of the machine to the controller; wherein the controller receives information regarding a location of a machine structure of the machine, and wherein the controller is configured to establish a first virtual boundary proximate to the machine structure in view of the information regarding the location of the machine structure; wherein the controller is configured to receive operator commands regarding one or more functions of the work tool of the machine; and wherein, when the work tool reaches the first virtual boundary, the controller inhibits one or more functions of the work tool while at the same time allowing other functions of the work tool.

17 Claims, 5 Drawing Sheets

DIFFERENT BOUNDARIES FOR IMPLEMENT FUNCTIONS WITH VIRTUAL FENCE TO AVOID TIRE OR STRUCTURAL DAMAGE

TECHNICAL FIELD

The present disclosure generally relates to a work machine. More particularly, the present disclosure relates to a system and method to prevent structural damage to the machine.

BACKGROUND

Work machines, such as motor graders, are used to prepare the grade of a ground surface in an area. Motor graders are used primarily as a finishing tool to sculpt a surface of a construction site to a final shape and contour. Typically, motor graders include many hand-operated controls to steer the wheels of the grader, position a blade, and articulate the front frame of the grader. The blade is adjustably mounted to the front frame to move relatively small quantities of earth from side to side. In addition, the articulation of the front frame is adjusted by rotating the front frame of the grader relative to the rear frame of the grader.

To produce a final surface contour, the blade and the frame may be adjusted to many different positions. Positioning the blade of a motor grader is a complex and time-consuming task. Frequently, an operator will desire one or more unique blade positions. However, due to the geometry of the motor grader, some adjustments of the blade position may lead to collisions of the blade with parts of the motor grader. Such collisions may damage the blade, motor grader, or both.

Protection systems have been developed to prevent damage to tires or other machine structures by contact with the work tool, such as the motor grader blade. When the work tool approaches a protected zone around the tire or other structure, all commands resulting in motion toward the zone are limited, and then completely inhibited once the boundary is reached.

JPH11280106 discusses an interference prevention device for construction machinery.

SUMMARY

In an example according to this disclosure, an automated system for a machine can include a controller; and a plurality of position sensors to deliver information regarding a position of a work tool of the machine to the controller; wherein the controller receives information regarding a location of a machine structure of the machine, and wherein the controller is configured to establish a first virtual boundary proximate to the machine structure in view of the information regarding the location of the machine structure; wherein the controller is configured to receive operator commands regarding one or more functions of the work tool of the machine; and wherein, when the work tool reaches the first virtual boundary, the controller inhibits one or more functions of the work tool while at the same time allowing other functions of the work tool.

In one example, a motor grader can include a front end including a pair of steerable tires connected to the front end; a rear end pivotally connected to the front end at an articulation joint, the rear end including a power source operatively coupled to at least two driven tires; a drawbar-circle-moldboard assembly having a blade, the drawbar-circle-moldboard assembly configured for horizontal movement transverse to a longitudinal axis of the front end, and configured for vertical movement, the blade being operatively connected for rotational, horizontal, vertical, and pitch movement as part of the drawbar-circle-moldboard assembly; a controller; and a plurality of position sensors to deliver information regarding a position of the blade to the controller; wherein the controller receives information regarding a location of front tires and the rear tires, and wherein the controller is configured to establish a first virtual boundary proximate to each of the front tires and the rear tires in view of the information regarding the location of the front tires and the rear tires; wherein the controller is configured to receive operator commands regarding one or more functions of the blade of the motor grader; and wherein, when the blade reaches the first virtual boundary, the controller inhibits one or more functions of the blade while at the same time allowing other functions of the blade.

In one example, a work machine can include a frame including a machine structure; a movable work tool having a plurality of different functions; a controller; and a plurality of position sensors to deliver information regarding a position of the movable work tool of the machine to the controller; wherein the controller receives information regarding a location of the machine structure of the machine, wherein the controller is configured to establish a first virtual boundary proximate to the machine structure in view of the information regarding the location of the machine structure; and wherein the controller is configured to receive operator commands regarding one or more functions of the work tool of the machine; and wherein, when the work tool reaches the first virtual boundary, the controller inhibits one or more functions of the movable work tool while at the same time allowing other functions of the moveable work tool.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
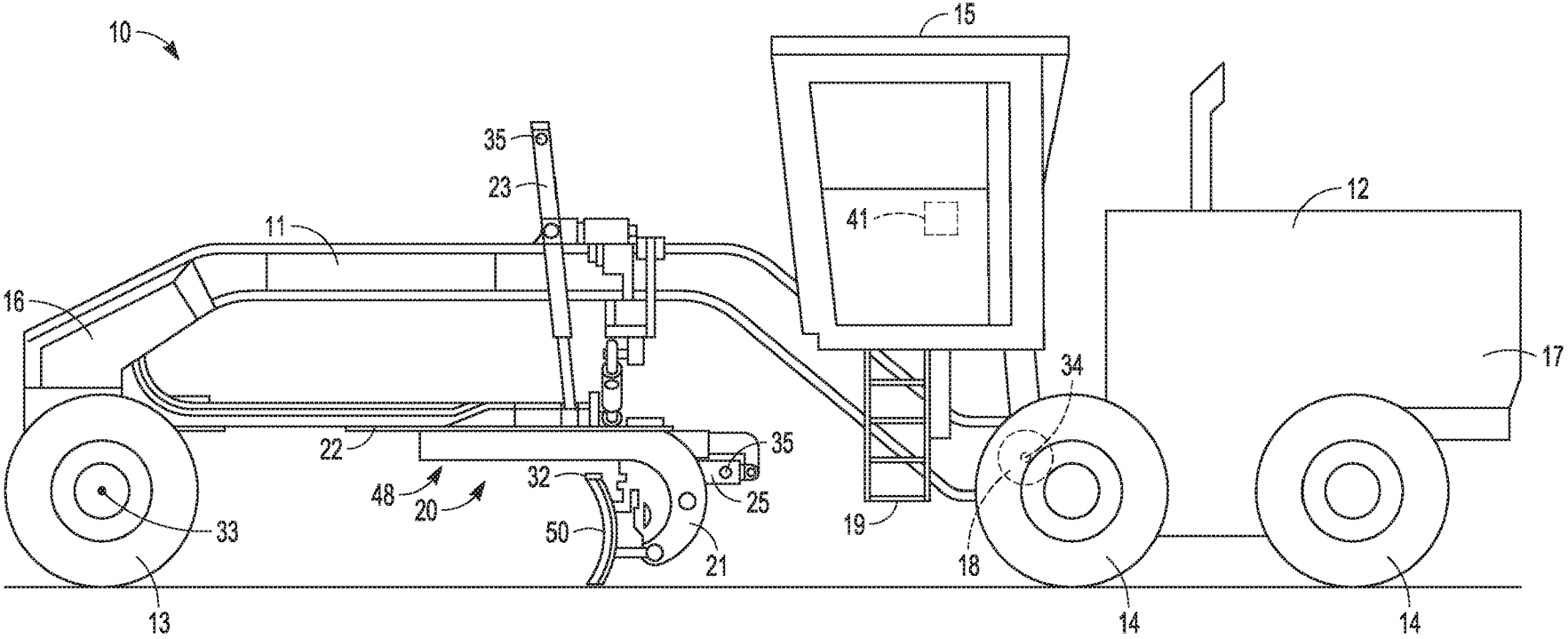
FIG. 1 shows a side view of a motor grader, in accordance with one embodiment.

FIG. 1 shows a side view of a work machine, such as a motor grader 10, in accordance with one embodiment. The motor grader 10 generally includes a frame 11 and a power source such as an engine 12. A set of steerable front tires 13 may be operatively connected to the frame 11 generally adjacent a front end 16 of the motor grader 10 and two sets of rear tires 14 may be operatively connected to the frame 11 generally adjacent a rear end 17 of the motor grader 10. The rear end 17 of the frame 11 is pivotally coupled to the front end 16 at an articulation joint 18. In one embodiment, only a single set of rear tires 14 may be provided. One or both sets of rear tires 14 may be powered by a power transfer mechanism operatively connected to the engine 12. An operator cab 15 may be mounted on the frame 11 and includes various controls, sensors and other mechanisms used by an operator. The operator cab 15 can be reached using a ladder 19.

The motor grader 10 can include a drawbar-circle-moldboard assembly (DOA) 20 having a blade 50. The DCM 20 can include a drawbar member 22 supported by the frame 11 and a ball and socket joint (not shown) located proximal front tires 13. As one or more hydraulic cylinders, such as center shift cylinders 24 are actuated, DCM 20 may pivot about the ball and socket joint.

A rotatable circle assembly 48 can be connected to the drawbar member 22. The blade 50 can be mounted on a blade tilt adjustment mechanism 21 that is supported by the rotatable circle assembly 48 operatively connected to the blade tilt adjustment mechanism 21. A variety of hydraulic cylinders or other mechanisms may be provided for controlling the position of the blade 50. For example, circle assembly 48 may be supported by a pair of blade lift cylinders 23 (with only one visible in FIG. 1). Adjustment of the blade lift cylinders 23 allows the height of rotatable circle assembly 48, and hence the height of blade 50, to be adjusted. Blade lift cylinders 23 may be moved independently or in combination with each other. Center shift cylinders 24 may be provided to shift the circle assembly 48 from side-to-side. A blade tip cylinder 25 may be provided to control the pitch, or angle between an edge of the blade 50 and the ground. One or more side shift cylinders (not shown) may be provided to control lateral movement of the blade 50 relative to the circle assembly 48. The circle assembly 48 may include a mechanism such as gear teeth to allow rotation of the blade 50. Other manners of positioning and controlling the blade 50 may be utilized if desired.

Accordingly, the DCM 20 can be configured for horizontal movement transverse to a longitudinal axis of the front end 16, and configured for vertical movement, such that the blade 50 can be operatively connected for rotational, horizontal, vertical, and pitch movement as part of the drawbar-circle-moldboard assembly 20.

A variety of sensors can be used on the work machine to determine the location and position of the blade relative to machine structures such as the front tires 13, rear tires 14, and the ladder 19. For instance, one or more sensors 32 can be placed on the blade 50 and/or the DCM 20 to determine the location and position of the blade 50. The one or more sensors 32 can include linear position sensors to determine horizontal shift of the blade 50 and articulation sensors, such as angular sensors, on the blade 50 or DCM 20 to determine how far the blade 50 is rotated. One or more sensors can also be placed on one or more of the machine structures. For example, one or more sensors 33 can be located on or near front tires 13 to determine the location of the front tires and the rotation of the front tires. A sensor 34 can be located at the articulation joint 18 to determine the relative articulation of the front end 16 relative to the rear end 17. Moreover, one or more position sensors 35 can be associated with some or all of the hydraulic cylinders that are used to control the blade 50, the blade tilt adjustment mechanism 21 and the circle assembly 48. In some examples, inertial sensors can be placed on the primary structures (such as the frame 11, the DCM 20, and the blade 50) to determine the relative position of each of the structures. These sensors can also help determine the position of the blade relative to machine structures if blade attachments such as snow-wings or other attachments are put on the blade. Other position sensors can also be utilized, such as optical sensors.

Position sensors 35 can sense the extension and retraction of the blade lift cylinders 23, the center shift cylinders 24, the blade tip cylinder 25, and the sideshift cylinders, or any other hydraulic cylinders on the work machine. In some examples, the position sensors 35 may embody magnetic pickup type sensors associated with magnets embedded within the piston assemblies of the blade lift cylinder 23, the center shift cylinders 24, and the blade tip cylinder 25. Sensors 35 may alternatively, embody other types of position sensors such as, for example, magnetostrictive-type sensors, cable type sensors associated with cables externally mounted, internally or externally mounted optical type sensors, or any other type of position sensor known in the art. The extension and retraction of the cylinders may be compared with reference look-up maps and/or tables stored in a memory of a control system 41 to determine the position and orientation of blade 50.

As noted, sensors 32, 34 can include articulation sensors, such as an angular sensor. For example, sensor 34 can sense the movement and relative position of articulation joint 18 and may be operatively coupled with articulation joint 18. Some examples of suitable articulation sensors 32, 34 include, among others, length potentiometers, radio frequency resonance sensors, rotary potentiometers, machine articulation angle sensors and the like. The movement of articulation joint 18 can also be compared with reference look-up maps and/or tables stored in the memory of the control system 41 to determine the articulation of machine 10 to help determine the position of the blade 50, the front wheels 13, and the rear wheels 14.

Figure 2:
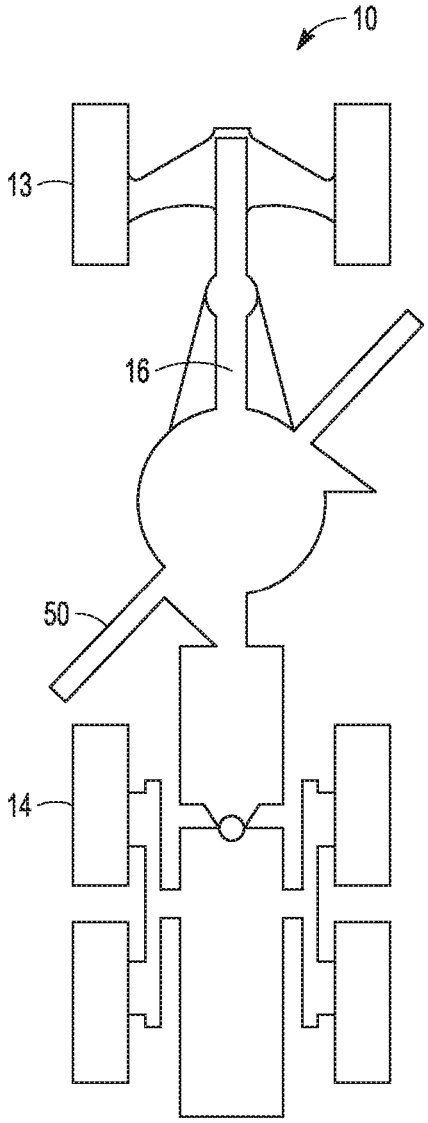
FIG. 2 shows a top view of a motor grader, in accordance with one embodiment.
Figure 3:
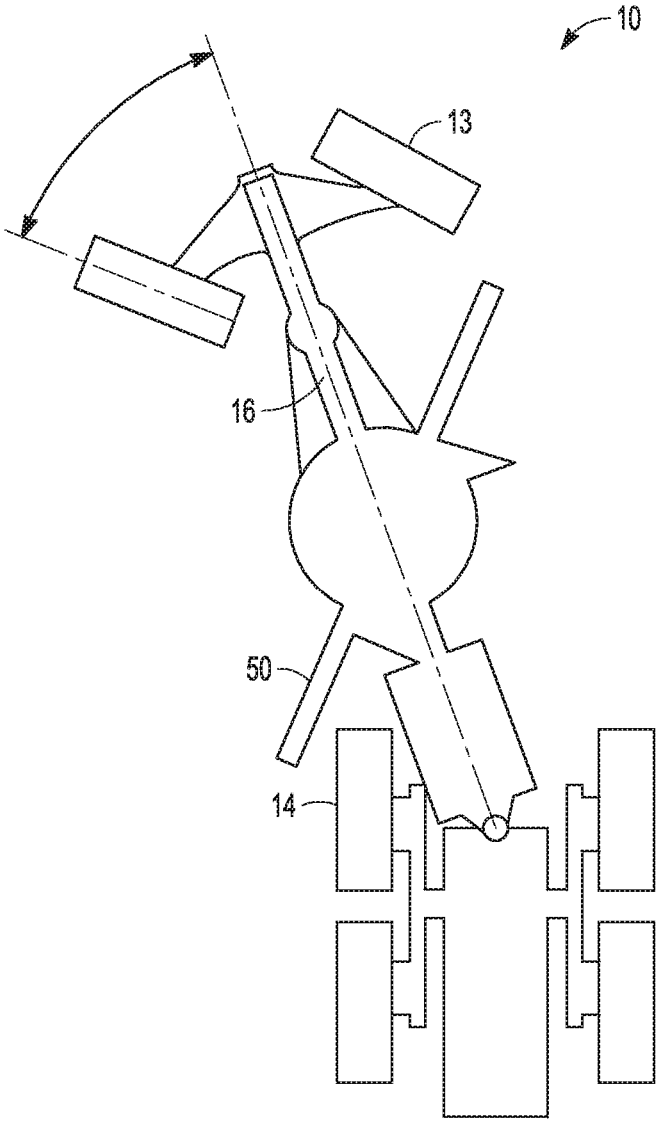
FIG. 3 shows a top view of a motor grader, in accordance with one embodiment.

FIGS. 2 and 3 show a top schematic view of the motor grader in various positions, in accordance with one embodiment. A motor grader can have many complex orientations. Because of the articulation of the front end 16 relative to the back end, the rotation of the blade 50, and the turning of the front tires 13, the blade 50 can end up in many different positions relative to the front tires 13 and the rear tires 14. This can make it difficult for the operator to know the relative positions of the blade 50 to certain machine structures, such as the tires.

As noted above, manufacturers have developed collision detection systems to prevent damage to tires or machine structures by contact with the work tool, such as the blade 50. For example, when the work tool approaches a protected zone around the tire/structure, all commands resulting in motion toward the zone are limited and then completely inhibited once the boundary is reached. Motion of the work tool away from the zone is still allowed. The problem is that the inhibition can interfere with the desired operating behavior of the machine, such as maintaining grade.

Accordingly, the present system relates to a blade control system associated with a movable work tool of a work machine, such as the blade of the motor grader 10. The present system is configured to set different proximity thresholds or virtual boundaries associated with different functions of the work tool, thereby forming a flexible protected zone surrounding tires and/or other machine structures of the work machine. As will be discussed in detail below, during operation of the work tool, the present system identifies at least one function that meets its corresponding proximity threshold, and accordingly, inhibits the identified function of the work tool while allowing the work tool to perform other functions.

Accordingly, referring again to FIG. 1, the work machine, such as the motor grader 10, can include the control system 41 to aid the operator during movement of the work tool, here blade 50. The control system 41 can receive operator input command signals and control the operation of the various systems of the motor grader 10. The control system 41 can include one or more input devices to control the motor grader 10, and receive input signals from one or more sensors, such as the sensors 32, 33, 34, 35 discussed above, and other input signals representative of various operating parameters of the motor grader 10.

Figure 4:
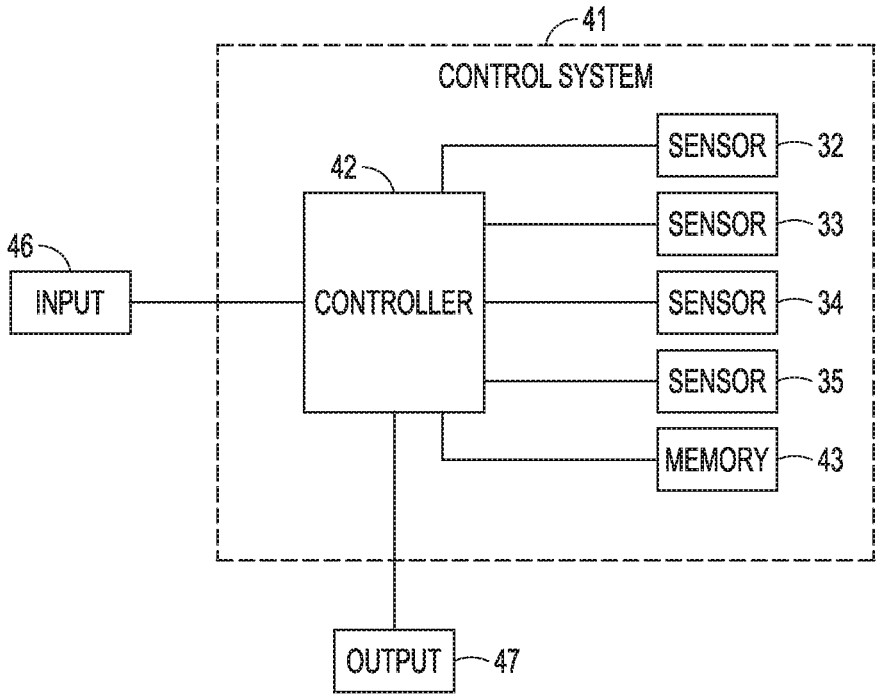
FIG. 4 shows a schematic of a control system, in accordance with one embodiment.

FIG. 4 shows a schematic of the control system 41, in accordance with one embodiment. The control system 41 generally includes a controller 42 and the one or more position sensors 32, 33, 34, 35 to deliver information regarding a position of the blade 50 to the controller 42. The controller 42 further receives information regarding a location of the front tires 13 and the rear tires 14. For example, the location and the position of the front tires can come from the sensor 33 on the front tires and from a memory 43. The memory 43 can include look-up tables and other information that allows the controller 42 to determine the location of the front tires relative to the blade 50. Further, the memory can determine the location of the rear tires 14 and the ladder 19 by referring to sensors or information from the memory 43, Using the information, the controller 42 can be configured to establish one or more virtual boundaries proximate the machine structures to prevent the blade 50 from contacting the machine structure.

For example, the controller 42 can create the virtual boundaries from data stored in the memory 43. Such stored data may include the location of various data points defining a geometry, location, and orientation of each machine structure relative to an origin of a three-dimensional global coordinate system. Data received from the sensors 32, 33, 34, 35 can be used in conjunction with the stored data to create the machine structure representations, if desired.

The controller 42 can be configured to receive operator commands via input 46 regarding one or more functions of the blade 50 of the motor grader 10 to be output to an output 47. Output 47 represents schematically all the hardware and software that controls all the hydraulic cylinders and other mechanisms to control the movements and functions of the blade 50. For example, output 47 may actuate blade lift cylinders 23, center shift cylinder 24 and blade tip cylinder 25 and sideshift cylinders to move blade 50 to a desired position. The controller 42 can be configured such that, when the blade 50 reaches the first virtual boundary, the controller 42 inhibits one or more functions of the blade 50 while at the same time allowing other functions of the blade 50.

Figure 5:
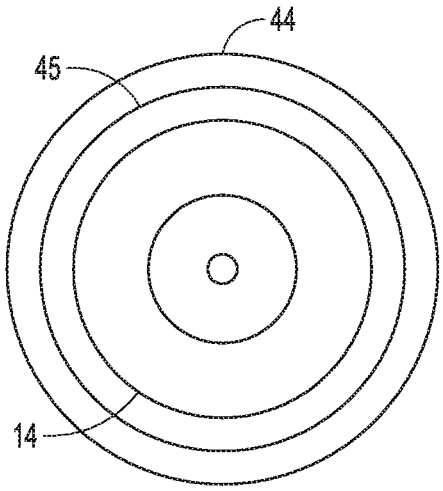
FIG. 5 shows a side view of a tire and a virtual boundary protection system, in accordance with one embodiment.
Figure 6:
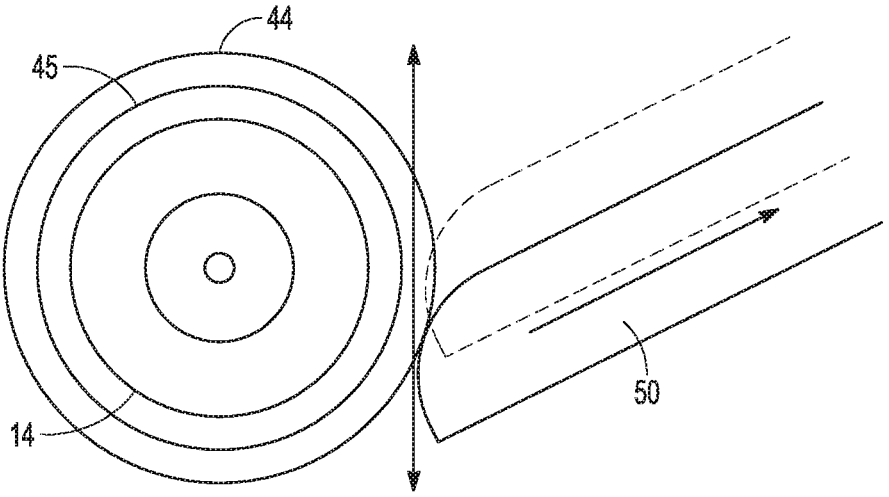
FIG. 6 shows a side view of a tire and a virtual boundary protection system, in accordance with one embodiment.
Figure 7:
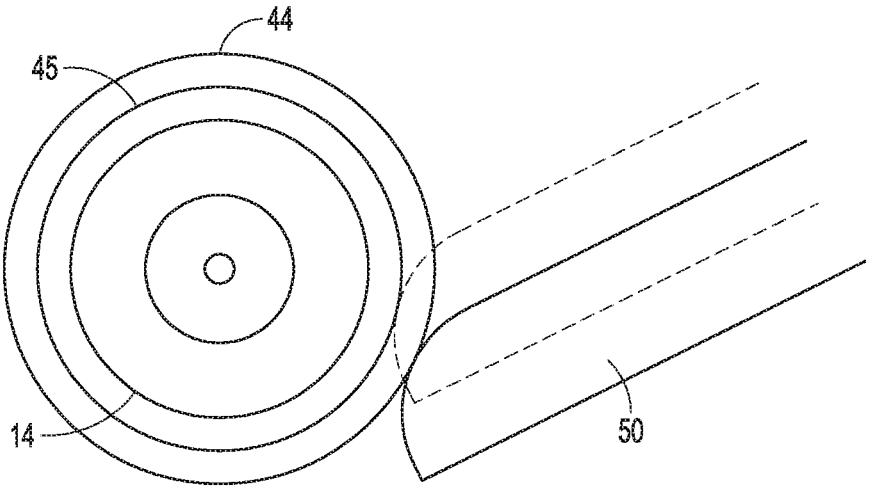
FIG. 7 shows a side view of a tire and a virtual boundary protection system, in accordance with one embodiment.

For example, FIGS. 5, 6, and 7 show a side view of a tire and a virtual boundary protection system, in accordance with one embodiment.

FIG. 5 shows an example of a first virtual boundary 44 and a second virtual boundary 45 proximate to the rear tire 14. The second virtual boundary 45 is closer to the rear tires 14 than the first virtual boundary 44. As noted, such virtual boundaries could also be established proximate the front tires 13, the ladder 19, or any other pertinent machine structure. For example, other machine structures that can be protected can include a linkbar, access platforms, and access stairs. In an example, the virtual boundary around the front tire 13 can be spherical. This allows a full range of steering by the operator while preventing the blade 50 from getting too close to the tires.

FIG. 6 shows how the operator can articulate, circle, or sideshift the blade 50 to a working position near the tire 14. As the blade approaches the protection zone first virtual boundary 44, the command is reduced, or limited, and when the blade 50 reaches the first virtual boundary 44, articulation, rotational and horizontal sideshift commands moving the blade 50 towards the tire 14 are fully inhibited. However, the operator still has the ability to raise and lower the blade 50. Thus, allowing the operator to optimally maintain the ability to grade properly.

FIG. 7 shows how, depending on the position at which the first virtual boundary 44 was reached, raise or lower commands may be limited and then fully, inhibited by the second virtual boundary 45 when the blade 50 is raised high enough to broach the second virtual boundary 45. Accordingly, any vertical movement of the blade 50 toward the tire 14 is inhibited. Movement of the blade 50 away from the tire 14 is allowable. Thus, in the example shown in FIG. 7, when the blade 50 reaches the second virtual boundary 45, the blade 50 can be lowered away from the second virtual boundary 45, but not raised any higher.

In other exemplary embodiments, each implement function of the work machine raise, lower, circle, tilt (blade pitch), articulation, sideshift, etc.) could have a distinct virtual boundary associated therewith such that the highest priority functions for proper grading have the innermost boundaries. In another example, each of the implement functions can be prioritized so as to maintain a desirable machine behavior during blade movement.

In some examples, the first virtual boundary 44 can be 150 mm from a surface of the tire 14 and the second virtual boundary 45 can be 50 mm from the surface of the tire. Thus, rotation of the blade 50 toward the tire 14 can be inhibited when the blade 50 is within 150 mm of the tire 13, 14, whereas vertical lifting and lowering of the blade 50 may remain active until the blade is within 50 mm of the tire. This allows the operator to rotate the blade to an extreme angle and still be able to grade normally. This feature helps avoid costly structural damage without interfering with other desired work tool operations, e.g., maintaining grade. In some examples, the distance of the virtual boundaries from the machine structure can be programmable into the controller 42 and thus, for example, the virtual boundaries can be a variable that can change based on machine wear, operator skill, etc.

Other work machine structures can be protected. For example, the controller 42 can further receive information regarding a location of the cab ladder 19 of the machine, and the controller 42 can be configured to establish a first virtual boundary and a second virtual boundary proximate the ladder 19 in view of the information regarding the location of the ladder 19.

INDUSTRIAL APPLICABILITY

The present system can be applicable to a work machine such as a motor grader having a blade. Other work machines that can benefit from the system include an excavator, a backhoe loader, an agricultural tractor, a wheel loader, a skid-steer loader, or any other type of machine having a movable work tool.

In use, the protection system establishes different proximity thresholds or virtual boundaries associated with different functions of the work tool. The system forms a flexible protected zone or "virtual fence" surrounding tires and/or machine structures of the work machine by forming two or more virtual boundaries. Then, during operation of the work tool, the protection system identifies at least one function that meets its corresponding proximity threshold, and accordingly, inhibits the identified function of the work tool while allowing the work tool to perform other functions.

Thus the present system can be applied to provide an automated system for a work machine, where the system includes the controller 42 and a plurality of position sensors to deliver information regarding a position of a work tool of the machine to the controller 42. The controller 42 can further receive information regarding a location of a machine structure of the machine. The controller 42 is configured to establish a first virtual boundary proximate to the machine structure in view of the information regarding the location of the machine structure. The controller 42 can be configured to receive operator commands regarding one or more functions of the work tool of the machine, and when the work tool reaches the first virtual boundary, the controller inhibits one or more functions of the work tool while at the same time allowing other functions of the work tool.

In various options, the controller 42 further establishes a second virtual boundary proximate to the machine structure, wherein the second virtual boundary, is closer to the machine structure than the first virtual boundary. When the work tool reaches the second virtual boundary, the controller inhibits all the functions of the work tool that would allow the work tool to encroach the virtual boundary.

In some options, movement of the work tool is limited by the controller as the work tool comes near to the first virtual boundary. The work tool is slowed down as it nears the virtual boundary and then totally inhibited from moving towards the machine structure when it reaches the virtual boundary.

In some examples, the controller 42 can establish a plurality of virtual boundaries having different distances from the machine structure, and wherein different functions of the work tool are inhibited or allowed depending on the location of the work tool relative to each of the plurality of virtual boundaries.

The present work tool control system can be applied to many types of work machines having a variety of movable work tools, as noted above. For example, a work machine can include a frame including a machine structure and a movable work tool having a plurality of different functions. The work machine can include the control system 41 to control movement and function of the work tool. For example, the system 41 can include the controller 42 and a plurality of position sensors to deliver information regarding a position of the movable work tool of the machine to the controller 42. The controller 42 can establish a first virtual boundary proximate to the machine structure in view of information regarding the location of the machine structure. The controller is further configured to receive operator commands regarding one or more functions of the work tool of the machine, and when the work tool reaches the first virtual boundary, the controller inhibits one or more functions of the movable work tool while at the same time allowing other functions of the moveable work tool.

Figure 8:
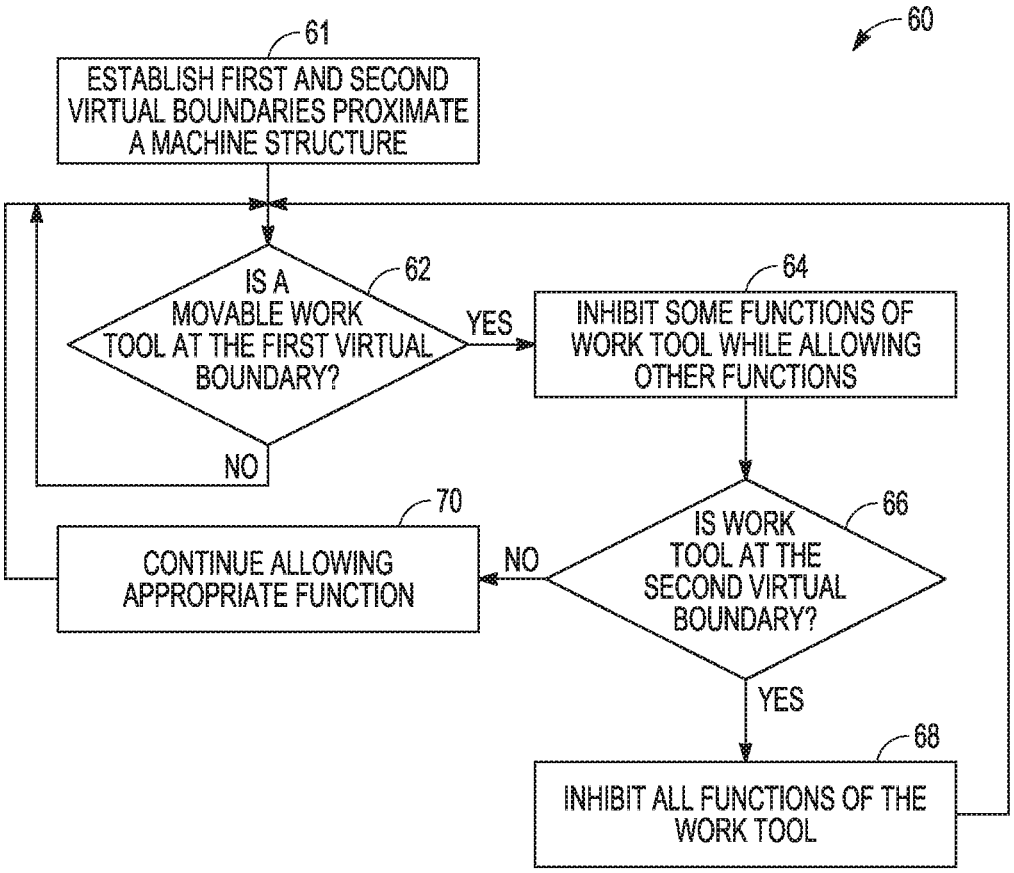
FIG. 8 shows a method of preventing machine structural damage by a work tool, in accordance with one embodiment.

FIG. 8 shows a schematic of a method 60 to provide an automated protection system for a work machine. At step 61, the method establishes first and second virtual boundaries proximate to a machine structure of the work machine. As discussed above, the first virtual boundary can be farther from the surface of the machine structure than the second virtual boundary. At step 62, the method decides whether the moveable work tool has reached or passed the first virtual boundary. If the work tool has not reached the boundary the method loops back up to step 62 to continually ask the same question. If the work tool has reached the first virtual boundary, then at step 64 some functions of the work tool are inhibited while other functions are allowed to be used. At step 66, the method queries whether the work tool has reached the second virtual boundary. If not, the allowable function is allowed to continue at step 70, and the function loops up to continually ask the same query. If the work tool has reached the second virtual boundary, then at step 68 all functions of the work tool are inhibited from allowing the work tool to be moved towards the machine structure. The method then loops back up to step 62, until the work tool has moved a safe distance from the machine structure to allow the tool to function fully.

In summary, the present system, as discussed above, provides an automated operator assist system for prevention of machine structural damage. Specifically, the present system provides an automated operator assist "virtual fence" system to prevent damage to tires or other machine structures by contact with the work tool; in particular, the system establishes virtual boundaries in proximity to machine structures, and monitors operator-initiated work tool actuation commands, machine position, and work tool position, and inhibits certain work tool actuation commands and work tool positions which may result in the work tool contacting the machine structure, while at the same time allowing other work tool actuation commands which will not interfere with the machine structure.

While applicable to any work machine having a movable work tool, this present protection system is especially suited to motor graders since motor graders have a particularly unique and complex configuration, and have a complex range of motion, etc. Motor graders are complex machines and have a broad range of operational orientations and relations therebetween, e.g., articulation joint, front tires/axles, blade, etc. There is a high susceptibility to tire damage due to contact with the blade.

The above detailed description is intended to be illustrative, and not restrictive. The scope of the disclosure should, therefore, be determined with references to the appended claims, along with the full scope of equivalents to which such claims are entitled.

What is claimed is:

1. An automated system for a machine comprising:

a controller;

a plurality of position sensors to deliver information regarding a position of a work tool of the machine to the controller;

wherein the controller receives information regarding a location of a machine structure of the machine, wherein the controller is configured to establish a first virtual boundary proximate to the machine structure in view of the information regarding the location of the machine structure;

wherein the controller is configured to receive operator commands regarding one or more movement functions of the work tool of the machine wherein the operator commands inform the controller to perform one or more actions resulting in one or more different movements of the work tool; and wherein, when the work tool reaches the first virtual boundary, the controller inhibits one or more of the movement functions of the work tool while at the same time allowing other movement functions of the work tool to proceed.

2. The system of claim 1, wherein the controller further establishes a second virtual boundary proximate to the machine structure, wherein the second virtual boundary is closer to the machine structure than the first virtual boundary.

3. The system of claim 2, when the work tool reaches the second virtual boundary, the controller inhibits all the functions of the work tool that would allow the work tool to encroach the second virtual boundary.

4. The system of claim 1, wherein a movement of the work tool is limited by the controller as the work tool comes near to the first virtual boundary.

5. The system of claim 1, wherein the controller establishes a plurality of virtual boundaries having different distances from the work tool, and wherein different movement functions of the work tool are inhibited or allowed depending on the location of the work tool relative to each of the plurality of virtual boundaries.

6. The system of claim 1, wherein the machine structure is a tire of the machine.

7. The system of claim 6, wherein the controller further establishes a second virtual boundary proximate to the machine structure, wherein the first virtual boundary is 150 mm from a surface of the tire and the second virtual boundary is 50 mm from the surface of the tire.

8. The system of claim 1, wherein the plurality of position sensors includes linear position sensors and angular sensors.

9. A motor grader comprising:

a front end including a pair of steerable tires connected to the front end;

a rear end pivotally connected to the front end at an articulation joint, the rear end including a power source operatively coupled to at least two driven tires;

a drawbar-circle-moldboard assembly having a blade, the drawbar-circle-moldboard assembly configured for horizontal movement transverse to a longitudinal axis of the front end, and configured for vertical movement, the blade being operatively connected for rotational, horizontal, vertical, and pitch movement as part of the drawbar-circle-moldboard assembly; and a controller;

a plurality of position sensors to deliver information regarding a position of the blade to the controller;

wherein the controller receives information regarding a location of front tires and the rear tires, and wherein the controller is configured to establish a first virtual boundary proximate to each of the front tires and the rear tires in view of the information regarding the location of the front tires and the rear tires;

wherein the controller is configured to receive operator commands regarding one or more functions of the blade of the motor grader; and wherein, when the blade reaches the first virtual boundary, the controller inhibits one or more functions of the blade while at the same time allowing other functions of the blade, wherein when the blade reaches the first, virtual boundary, the controller inhibits rotational movement and horizontal movement of the blade towards the tire while allowing vertical movement of the blade.

10. The motor grader of claim 9, wherein the controller further establishes a second virtual boundary proximate to the front tires and the rear tires, wherein the second virtual boundary is closer to the front tires and the rear tires than the first virtual boundary, wherein when the blade reaches the second virtual boundary, the controller also inhibits the vertical movement of the blade towards the tire.

11. The motor grader of claim 10, wherein the first virtual boundary is 150 mm from a surface of each of the rear tires the second virtual boundary is 50 mm from the surface of each of the rear tires.

12. The motor grader of claim 9, wherein a movement of the blade is limited by the controller as the blade comes near to the first virtual boundary.

13. The motor grader of claim 9, wherein the controller further receives information regarding a location of a cab ladder of the machine, and wherein the controller is configured to establish a first virtual boundary proximate the cab ladder in view of the information regarding the location of the cab ladder.

14. The motor grader of claim 9, wherein the plurality of position sensors includes linear position sensors and angular sensors mounted to the blade.

15. A work machine comprising:

a frame including a machine structure;

a movable work tool having a plurality of different movement functions wherein the work tool can move in different directions;

a controller;

a plurality of position sensors to deliver information regarding a position of the movable work tool of the machine to the controller;

wherein the controller receives information regarding a location of the machine structure of the machine, wherein the controller is configured to establish a first virtual boundary proximate to the machine structure in view of the information regarding the location of the machine structure;

wherein the controller is configured to receive operator commands regarding one or more movement functions of the work tool of the machine; and wherein, when the work tool reaches the first virtual boundary, the controller inhibits one or more of the movement functions of the movable work tool while at the same time allowing other movement functions of the moveable work tool to proceed;

wherein the controller further establishes a second virtual boundary proximate to the machine structure, wherein the second virtual boundary is closer to the machine structure than the first virtual boundary, and wherein when the work tool reaches the second virtual boundary, the controller inhibits all the functions of the movable work tool.

16. The work machine of claim 15, wherein a movement of the work tool is limited by the controller as the work tool comes near to the first virtual boundary.

17. The work machine of claim 15, wherein the plurality of position sensors includes linear position sensors, inertial sensors or angular sensors.

* * * * *